US007043351B2

(12) United States Patent
Grossmann et al.

(10) Patent No.: US 7,043,351 B2
(45) Date of Patent: May 9, 2006

(54) METHOD FOR OPERATING AN INTERNAL COMBUSTION ENGINE

(75) Inventors: Alex Grossmann, Gernsbach (DE); Torsten Baumann, Eppingen-Adelshofen (DE); Torsten Keller, Bobenthal (DE); Sinan Yilman, Pluederhausen (DE); Boris Koehler, Vaihingen/Enz (DE); Bruno Zeyer, Marbach A.N. (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/957,175

(22) Filed: Sep. 30, 2004

(65) Prior Publication Data

US 2005/0109312 A1 May 26, 2005

(30) Foreign Application Priority Data

Sep. 30, 2003 (DE) ..... 103 45 311

(51) Int. Cl.
*G06G 19/00* (2006.01)
*F02D 11/10* (2006.01)
*F02D 9/10* (2006.01)

(52) U.S. Cl. ..... 701/103; 701/115; 123/336; 123/361

(58) Field of Classification Search ..... 123/226, 123/337, 361, 399, 403, 336; 261/36.2, 44.6; 701/102, 103, 110, 115
See application file for complete search history.

(56) References Cited

U.S. PATENT DOCUMENTS 4,305,892 A * 12/1981 Hallberg ..... 261/36.2
4,365,600 A * 12/1982 Nakada et al. ..... 123/336
4,633,833 A * 1/1987 Morris ..... 123/336
5,845,677 A * 12/1998 Kim ..... 123/336

* cited by examiner

*Primary Examiner*—Willis R. Wolfe, Jr.
(74) *Attorney, Agent, or Firm*—Kenyon & Kenyon LLP

(57) ABSTRACT

In an internal combustion engine, combustion air is supplied to at least one combustion chamber via at least one intake duct. The intake duct includes at least two parallel control sections, to each of which one final controlling device is allocated. Using these final controlling devices, the flow cross-section of the particular control section may be influenced. At least two final controlling devices are activated based on one single setpoint variable, and, in fact, using only one control and/or regulating system associated with the intake duct.

29 Claims, 6 Drawing Sheets

METHOD FOR OPERATING AN INTERNAL COMBUSTION ENGINE

FIELD OF THE INVENTION

The present invention relates first of all to a method for operating an internal combustion engine, where combustion air is supplied to at least one combustion chamber via an intake duct which includes at least two parallel control sections, to each of which a final controlling device is allocated, via which the flow cross-section of the particular control section may be influenced.

BACKGROUND INFORMATION

The present invention further relates to a computer program, an electrical memory medium for a control and/or regulating system of an internal combustion engine, a control and/or regulating system for an internal combustion engine, and an internal combustion engine, in particular for a motor vehicle.

A method is known from the market. It is used with internal combustion engines having a vee-type cylinder arrangement, for example. Each of the two cylinder banks of an internal combustion engine of this type has its own intake duct which, in turn, has its own throttle valve. The positions of the throttle valves are adjusted independently of each other via separate position regulating circuits. A separate setpoint value is generated for each position regulating circuit in a dedicated control unit.

An object of the present invention is to further develop a method of the type mentioned in the preamble such that the corresponding internal combustion engine is as compact and economical as possible.

In a computer program, the object is attained by programming the computer program for use in a method of the type described above. In an electrical memory medium, the object is attained by storing a computer program in the electrical memory medium for use in a method of the type described above.

In a control and/or regulating system, the object is attained by programming the control and/or regulating system for use, in this case, in a method of the type described above. In an internal combustion engine, the object is attained by the fact that it includes, in this case, a control and/or regulating system which is used in a method of the type described above.

SUMMARY OF THE INVENTION

In the method according to the present invention, the hardware which would be required to generate a second setpoint variable may be eliminated, because the final controlling devices are activated based on a common setpoint variable. For example, a second control unit which would be responsible for forming a second setpoint variable can be eliminated. Finally, with this method, adjustment of two final controlling devices of a single intake duct is therefore enabled using a single control unit. Costs and installation space are reduced as a result. Although the use of a single setpoint variable means that, in the normal case, the two final controlling devices cannot be adjusted differently from each other, this is, however, quite acceptable for many internal combustion engines having a single intake duct.

It is first proposed that each final controlling device have its own closed-loop position control to which the same setpoint variable is supplied. In this manner, each individual final controlling device may be adjusted optimally and under consideration of its individual mechanical properties. Manufacturing tolerances are compensated for very well in this manner.

It is particularly advantageous when a final controlling device includes at least two position sensors which detect the instantaneous position of a final controlling element belonging to the final controlling device, and that the plausibility of the signals from the position sensors of the final controlling device is monitored. The use of a plurality of position sensors and monitoring the plausibility of the signals from the position sensors increases the safety of operation of the internal combustion engine, because erroneous adjustments of the position of the final controlling element due to erroneous position recognition can be largely ruled out.

In a refinement of the present invention, it is proposed that, if an error occurs, a determination is made as to which of the position sensors of the final controlling device is defective by forming a value for a partial air-mass flow from the signals from the position sensors of each final controlling device and checking the determined values of the partial air-mass flow for plausibility by referencing them against a value of a measured total air-mass flow. Generally, the formation of the value of a partial air-mass flow from the signal from a position sensor is carried out indirectly, i.e., via the detour of determining an angle, e.g., using a characteristic curve and then determining the partial air-mass flow from the angle. Further operation of the internal combustion engine is enabled as a result, because, by identifying the faulty position sensor, its signal may be excluded from further use. The regulation of the position of the final controlling element is then based only on the signals from the position sensor which is functioning correctly.

A further advantageous embodiment of the method according to the present invention provides that each of the final controlling devices includes a clamping device which is capable of holding the final controlling element of a final controlling device in a neutral position, and an activating device which can move the final controlling element out of the neutral position, and that, to perform a function test, the activating devices of both final controlling devices are activated so that the final controlling elements move into a test position, and that, when both final controlling elements are in the test position, activation is ended and the period of time required for the final controlling elements to move from the test position into the neutral position is detected.

The clamping device provided according to the present invention provides that, even if the closed-loop position control fails completely, the final controlling element is brought into a certain neutral position in which an "emergency operation" of the internal combustion engine is possible. The clamping device is therefore a safety device. Its proper effect is given only when the final controlling element moves sufficiently smoothly, i.e., it does not "stick". This effect is investigated by the proposed method. Finally, this also makes the operation of the internal combustion engine safer as a result. In addition, separate activation of the final controlling devices is not required for this function test, because activation is basically not ended until the last final controlling element has reached its test position.

In a refinement of the present invention, it is proposed that the function test is carried out in separate test blocks for each final controlling device, the test blocks being coordinated with each other. This is simple to implement using software, and it allows a few tests within the test block to be carried out for one final controlling device fully independently of the other final controlling device, and it also allows other function tests to run simultaneously. This saves time so that the function test can be carried out relatively frequently.

It is further proposed that, in certain operating situations of the internal combustion engine, current properties of a final controlling device are detected independently of another final controlling device and are made available for activation. As a result, the precision of the adjustment of the final controlling device is improved. For example, changes in mechanical properties of the final controlling device due to wear or replacement of a final controlling element, and many other properties, may be determined currently and taken into account in the activation of the final controlling device. Due to the use of a dedicated learning and test block for each final controlling device, the learning and testing methods may be carried out independently of each other, i.e., simultaneously. As described above, this allows these methods to be carried out relatively frequently.

A further advantageous embodiment of the method according to the present invention is unique in that status information about a final controlling device and its components are stored independently of another final controlling device. Despite the use of a single setpoint variable to activate two final controlling devices, status information from one final controlling device is stored independently of the other final controlling device. This also increases safety, because, since status information is stored "in parallel," this information may be stored more frequently and is therefore particularly current.

It is further proposed that error information be evaluated jointly for all final controlling devices and that corresponding responses be triggered. This refinement takes into account the fact that an error identified in one final controlling device may affect the operation of the other final controlling device. Joint error evaluation therefore allows the overall situation of the internal combustion engine to be observed. In turn, this makes it easier to prevent damage to the internal combustion engine as a whole, and to protect the operator from danger.

It is particularly preferred if identical error information from the final controlling devices is gated using a logical "or". This means that, when a certain error type occurs in only one final controlling device, this is sufficient to trigger a certain error response.

DETAILED DESCRIPTION

Figure 1:
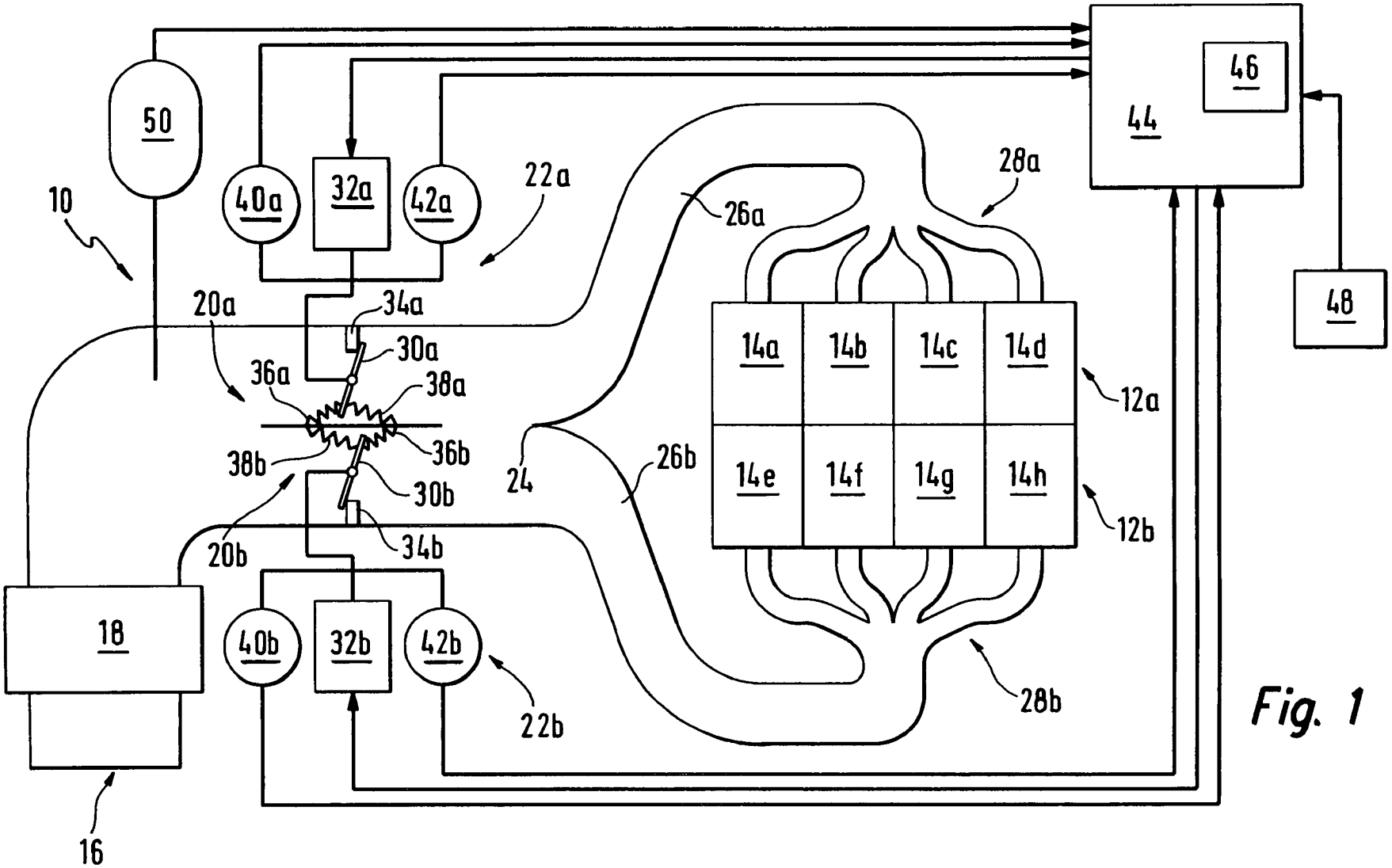
FIG. 1 shows a schematic representation of an internal combustion engine having two final controlling devices for influencing a flow cross-section of an intake duct.

An internal combustion engine is labeled in its entirety with reference numeral 10 in FIG. 1. It is used to drive a motor vehicle (not shown). Internal combustion engine 10 has two cylinder banks 12*a* and 12*b*, each of which has four cylinders and four combustion chambers 14*a* through 14*d* and 14*c* through 14*h*. These cylinder banks 12*a* and 12*b* are positioned relative to each other in the shape of a vee. The internal combustion engine 10 shown in FIG. 1 is therefore a V8-engine.

Combustion air is supplied to cylinders 14 of internal combustion engine 10 via an intake duct, an intake manifold 16 in this case. An air filter 18 is provided at the end of intake manifold 16 facing away from combustion chambers 14. Downstream of air filter 18, intake manifold 16 is divided into two control sections 20*a* and 20*b* which are parallel to each other. One final controlling device 22*a* and 22*b*, respectively, is allocated to each of these control sections. Using the final controlling devices, it is possible to influence the flow cross-section of corresponding control section 20*a* and/or 20*b*, as explained below in greater detail.

An intake manifold divider 24 is provided in intake manifold 16 downstream of control sections 20*a* and 20*b*, the intake manifold divider dividing intake manifold 16 into two intake manifold sections 26*a* and 26*b*, each allocated to one cylinder bank 12*a* and 12*b*, respectively. A manifold 28*a* and/or 28*b* further divides the air stream among the individual combustion chambers 14*a* through 14*d* and 14*e* through 14*h*.

Final controlling devices 22*a* and 22*b* are identical in design. For the sake of simplicity, the design of only final controlling device 22*a* will be discussed in greater detail below: It includes a final controlling element 30*a* configured as a throttle valve, which is movable into any position by an activating device 32*a*. A fully closed position of throttle valve 30*a* is defined by a "lower mechanical" stop 34*a*. A stop is also provided for the fully open position, although it is not shown in the figure. Two springs 36*a* and 38*a* act on throttle valve 30*a*, by way of which throttle valve 30*a* is brought into a neutral position (the "limp-home air position") if activating device 32*a* is switched off, i.e., de-energized. In the present exemplary embodiment, this neutral position corresponds to a degree of opening of approximately 6%.

Figure 2:
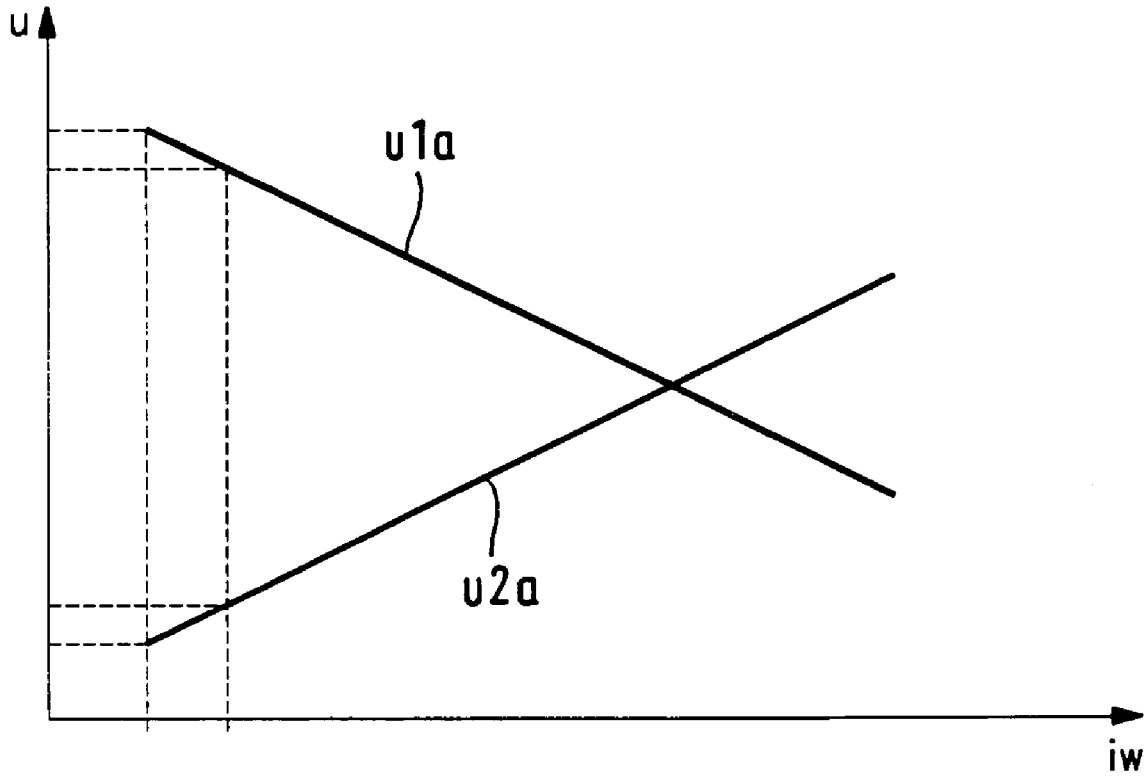
FIG. 2 shows a diagram in which characteristic curves of position sensors of a final controlling device from FIG. 1 are plotted.

The instantaneous position of throttle valve 30*a* is detected by two position sensors 40*a* and 42*a*; in this case, they are potentiometers, one each of which is coupled to a throttle valve. As shown in FIG. 2, the characteristic curves of position sensors 40*a* and 42*a*, which link a signal voltage u1*a* (position sensor 40*a*) and u2*a* (position sensor 42*a*) with an angle iw, are mirror images of each other.

Position sensors 40*a* and 42*a* supply corresponding signals to a control and regulating system 44, which outputs corresponding triggering signals to the activating device 32*a*. The control and regulating system, which will also be described in greater detail below, includes a closed control loop for adjusting the position of throttle valve 30*a*. In this process, only one single setpoint value is generated in a setpoint value generator 46 for both final controlling devices 22*a* and 22*b* in the control and regulating system, namely as a function of the position of a gas pedal 48, among other things. The total air mass flowing through intake duct 16 is detected by an HFM sensor 50, which also delivers corresponding signals to control and regulating system 44.

The operation of an internal combustion engine 10 will now be explained in greater detail with reference to FIG. 3:

The use of a single setpoint value wdks for activating throttle valves 30*a* and/or 30*b* is identical for both final controlling devices 22*a* and/or 22*b*. For the sake of simplicity, only the procedure for final controlling device 22*a* and/or throttle valve 30*a* will therefore be described below.

Setpoint variable wdks is supplied to a block 52*a*, to which an actual value iwa is also supplied, by an actual value generator 54*a*. In turn, voltage signals u1*a* and u2*a*, which are provided by potentiometers 40*a* and 42*a*, are supplied to the actual value generator. To this end, the current and mirror-symmetric characteristic curves of position sensors 40*a* and 42*a* are stored in actual value generator 54*a*. The characteristic curves are generated in a manner described in greater detail below.

Block 52*a* contains a position controller for throttle valve 30*a*, which is designed as a PID controller. Errors in the triggering circuit are also diagnosed in block 52*a*, however. The position controller contained in block 52*a* outputs a pulse-width modulated pulse duty factor and a directional bit to an end stage which is not shown in the figures. The end stage is designed as an integrated H-bridge having internal current-limit control. In block 52*a*, the position controller is also monitored for impermissible deviations of actual value iwa from setpoint value wdks. In addition, setpoint value wdks is monitored to determine if a range is exceeded, and the operating condition of the end stage is also monitored.

Figure 4:
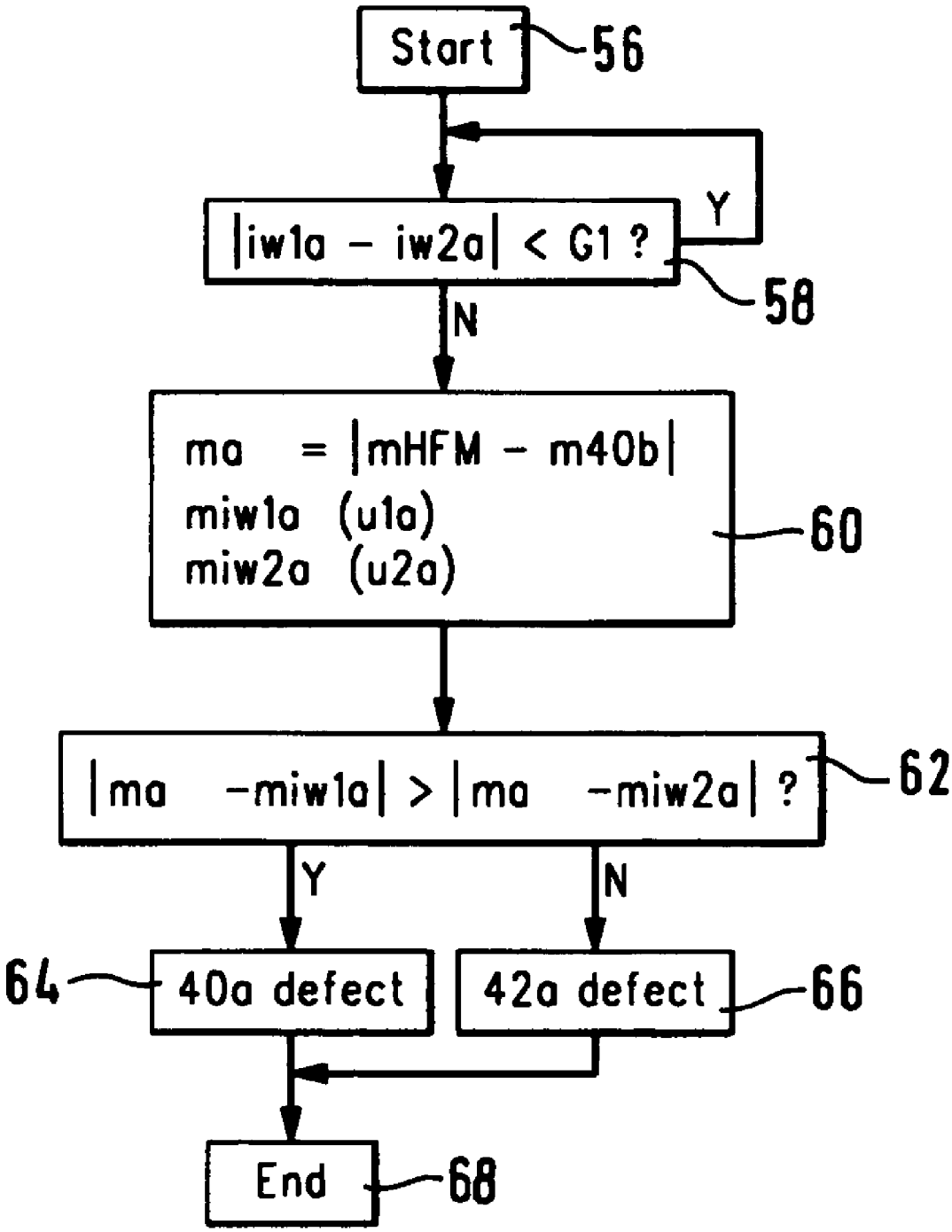
FIG. 4 shows a flow chart of a method for identifying a defective position sensor of one of the final controlling devices in FIG. 1.

The signals from both position sensors 40*a* and 42*a* are supplied to actual value generator 54*a*. Actually, however, only signal u1*a* from position sensor 40*a* is normally used to generate the actual value; actual angle iwa is thus equal to value iw1*a* obtained from the characteristic curve. Signal u2*a* from position sensor 42*a* is used to check signal u1*a* from position sensor 40*a* and is used when signal u1*a* has been recognized as being erroneous. This check takes place specifically as follows (see FIG. 4):

After a start block 56, the absolute value of the difference between actual values iw1*a* and iw2*a* is formed in 58; the difference is obtained from voltage signals u1*a* and u2*a* from position sensors 40*a* and 42*a*. If this amount is less than a limiting value G1, that is, if both position sensors 40*a* and 42*a* indicate positions of throttle valve 30*a* that are essentially identical, it is assumed that the signals which were supplied are correct. In this case, signal u1*a* from position sensor 40*a* and the corresponding characteristic curve are used to form actual value iwa, and the process jumps back to the input of block 58 (i.e., this check is carried out continually). The basis thereof is the consideration that it is unlikely that both position sensors 40*a* and 42*a* indicate an identical position of the throttle valve 30*a* if an error occurs, despite their having characteristic curves which run in opposite directions.

If the result of block 58 is "no," however, total air mass mHFM which flows through intake duct 16 is first determined in block 60 based on the signal from HFM sensor 50. Furthermore, air mass m40*b* flowing through control section 20*b* is determined from voltage signal u1*b* from position sensor 40*b* which is allocated to second throttle valve 30*b*, which has not yet been discussed explicitly (an angle is first determined from signal u1*b*, and from this, the corresponding mass flow m40*b* is then determined). It is assumed here that it is unlikely that position sensors 40*b* and 42*b* of second final controlling device 22*b* also yield an erroneous signal.

The absolute value of the difference is now formed from air mass mHF and m40*b*, which is supplied by the air mass flowing through control section 20*a*. Furthermore, the corresponding air masses miw1*a* and miw2*a* (one of which must be erroneous, based on the results of the query in block 58) are determined from signals u1*a* and u2*a* of position sensors 40*a* and 42*a* and the positions (angles) of throttle valve 30*a* determined from the signals.

A check is now run in block 62 to determine which of the two air masses miw1*a* or miw2*a* determined based on signals u1*a* and u2*a* best corresponds to the correct air mass ma. To accomplish this, a check is run to determine whether the difference between the correct air mass ma and air mass miw1*a* determined based on signal u1*a* of position sensor 40*a* is greater than the difference between correct air mass ma and air mass miw2*a* determined based on signal u2*a* of position sensor 42*a*. If the answer in block 62 is "yes," this means that sensor 40*a* is supplying an erroneous signal (block 64). If the answer in block 62 is "no," this means that position sensor 42*a* is supplying an erroneous signal (block 66). In the first case, the characteristic curve of position sensor 42 and/or value iw2*a* is used immediately to form actual value iwa. The procedure ends in block 68.

As mentioned above, the characteristic curves used in actual value generator 54*a* are updated continually. To this end, the current slopes of the characteristic curves and the voltage values of a defined position of throttle valve 30*a* are repeatedly made available to actual value generator 54*a*. They are made available in a learning and test block 70*a*. In the learning and test block, activating device 32*a* is activated in certain operating situations of internal combustion engine 10 in such a way that throttle valve 30*a* definitely rests against stop 34. An operating situation of this type is present, for instance, when the operator turns on the ignition of internal combustion engine 10 but the engine does not start right away.

When throttle valve 30*a* rests against stop 34, the corresponding voltage values of position sensors 40*a* and 42*a* are detected and stored. Activating device 32*a* is then de-energized, so that throttle valve 30*a* moves into the neutral position defined by the two clamping devices 36*a* and 38*a*, and the voltage values of the two position sensors 40*a* and 42*a* are read again. In this manner, the characteristic curves are defined unambiguously. In addition, this allows the voltage value corresponding to the neutral position to be detected. The voltage value is made available to the position controller in block 52*a* to enable the most precise pilot control of throttle valve 30*a* possible.

Figure 5:
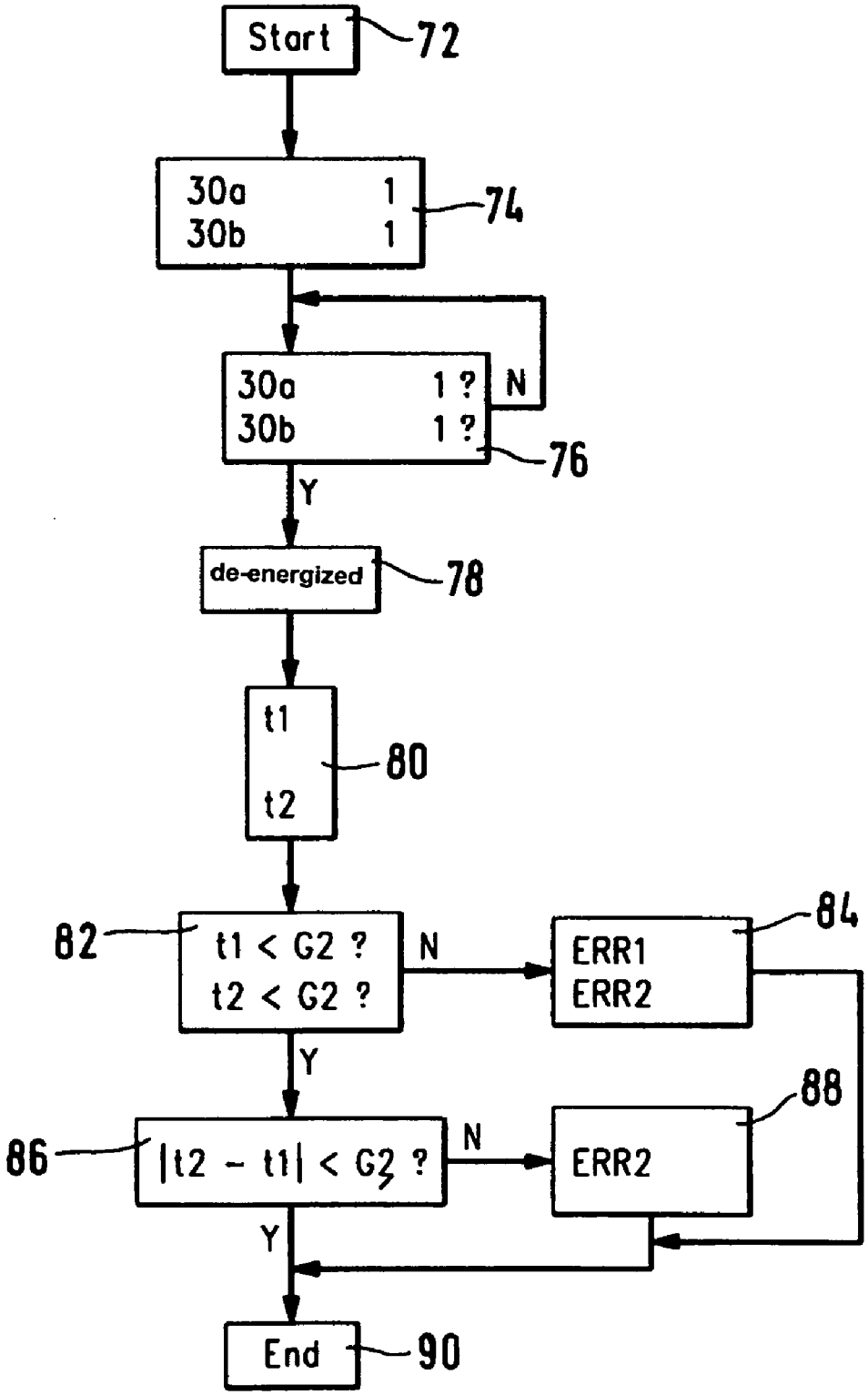
FIG. 5 shows a flow chart of a method for performing a function test of one of the final controlling devices in FIG. 1.

Another test is carried out in learning and test block 70*a*. For example, if an error is detected in an actual value amplification, the operational reliability of springs 36*a* and 38*a* is checked, and throttle valve 30*a* is checked for smoothness of movement and/or "sticking". The latter will now be explained with reference to FIG. 5:

After a start block 72, the two throttle valves 30*a* and 30*b* are moved into a defined position POS1 in block 74. In block 76, the signals from position sensors 40*a* and 42*a* and/or 40*b* and 42*b* are used to check whether the two throttle valves 30*a* and 30*b* have reached position POS1. If they have not, activation of activating devices 32 and/or 32*b* continues. It may be assumed that, due to manufacturing differences, throttle valves 30*a* and 30*b* do not reach position POS1 absolutely simultaneously. In the current method, however, in block 78, activating devices 32*a* and 32*b* are not de-energized (block 78) until the "slower" of the two throttle valves 30*a* or 30*b* has reached position POS1.

Time t1 is detected for throttle valve 30*a* and time t2 is detected for throttle valve 30*b*, the time being the period of time that elapses until the particular throttle valve 30*a* or 30*b* reaches the neutral position (also referred to as the "limp-home air position") defined by springs 36*a* and 38*a*. The corresponding time values t1 and t2 are detected in block 80 of FIG. 5.

A check is carried out in block 82 to determine whether the detected time values t1 and t2 are less than a limiting value G2. If one of the time values t1 or t2 reaches at least limiting value G2, this means that the corresponding throttle valve 30*a* or 30*b* does not move as smoothly as desired, or that one of the springs 36 or 38 is broken. A corresponding error message ERR1 or ERR2 is therefore generated in block 84. If the answer in block 82 is "yes," however, another check is carried out in block 82 to determine whether the absolute value of the difference between times t1 and t2 is less than a limiting value G3. In this manner, wear on one side of a throttle valve 30*a* or 30*b* may be detected. Depending on the result of the query in block 86, an error message ERR3 is generated in block 88, or the process jumps to End block 90.

Figure 3:
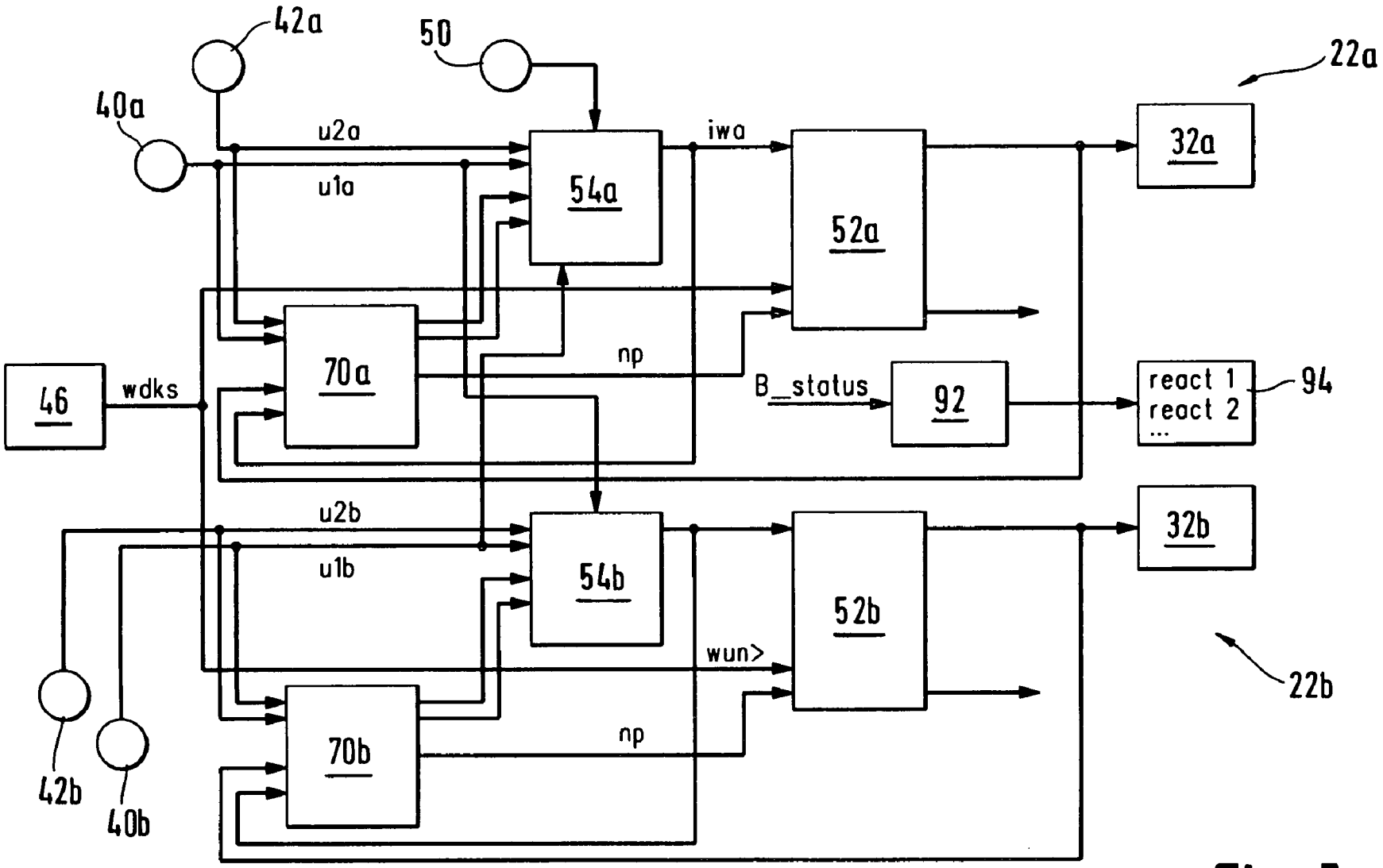
FIG. 3 shows a flow chart of a method for operating the two final controlling devices in FIG. 1.

As shown in FIG. 3, the different error states which are generated in the tests carried out in blocks 54*a* and 70*a* (and for throttle valve 30*b* in blocks 54*b* and 70*b*) are supplied to a response block 92. Depending on the type of error which is present, corresponding response procedures react1, react2, etc. (block 94) are implemented in response block 92. Identical error types occurring in the two final controlling devices 22*a* and 22*b* are gated in block 92 using a logical "or." If the error is present in only one final controlling device 22*a* or 22*b*, this is therefore sufficient to trigger a corresponding response. The responses may mean that the performance of the internal combustion engine is limited, that throttle valves 30*a* and 30*b* are being brought into the neutral position, or that internal combustion engine 10 has been brought to a standstill because fuel supply or fuel injection has been switched off.

Figure 6:
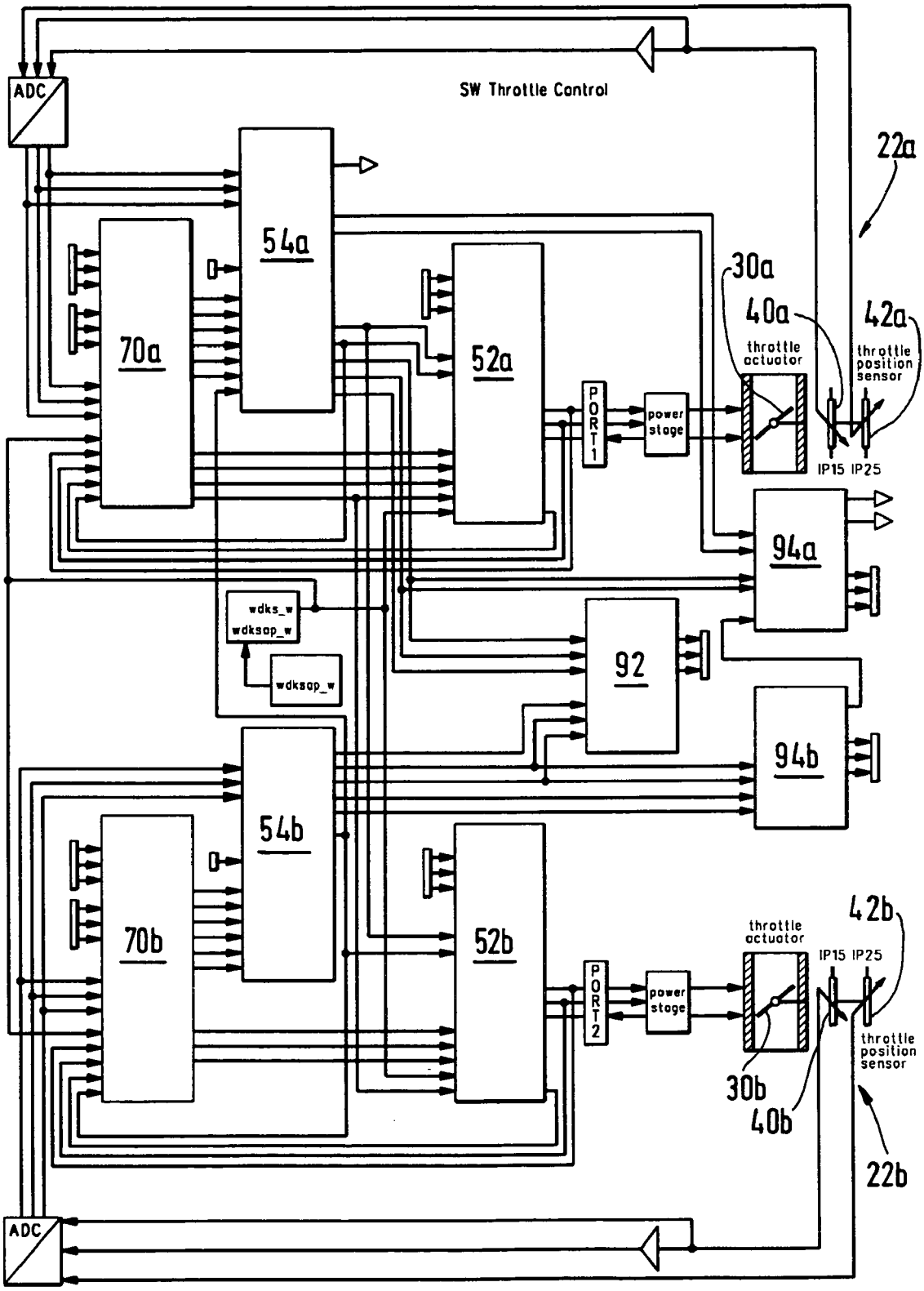
FIG. 6 shows a representation of the process scheme in FIG. 3 in greater detail.

As further shown in FIG. 6, a separate status memory 94*a* or 94*b* is provided for each final controlling device 22*a* and/or 22*b*, in which current status information regarding final controlling devices 22*a* and 22*b* and their components, e.g., final controlling elements 30, activating devices 32, springs 26 and 28, and position sensors 40 and 42 are stored. The two status memories 94*a* and 94*b* may be read out using a corresponding diagnostic tool during service of internal combustion engine 10.

What is claimed is:

1. A method for operating an internal combustion engine, comprising:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein, in certain operating situations of the internal combustion engine, instantaneous properties of a final controlling device are detected independently of another final controlling device and are made available for the activation.

2. A method for operating an internal combustion engine, comprising:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein status information about a final controlling device and its components is stored independently of another final controlling device.

3. A computer-readable medium having stored thereon instructions that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein each final controlling device has its own closed-loop position control to which the same setpoint variable is supplied.

4. An electrical memory medium for at least one of a control and regulating system of an internal combustion engine, the electrical memory medium storing a computer program that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein each final controlling device has its own closed-loop position control to which the same setpoint variable is supplied.

5. A control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein each final controlling device has its own closed-loop position control to which the same setpoint variable is supplied.

6. An internal combustion engine, comprising:

a control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein each final controlling device has its own closed-loop position control to which the same setpoint variable is supplied.

7. A computer-readable medium having stored thereon instructions that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein:

the final controlling devices each include one clamping device, each of which is able to hold the final controlling element of a respective final controlling device in a neutral position, and an activating device which is able to move the final controlling element out of the neutral position, to perform a function test, the activating devices of the final controlling devices are activated in such a way that the final controlling elements move into a test position when the final controlling elements are in the test position, activation is ended and a period of time required for the final controlling elements to move from the test position into the neutral position is detected.

8. An electrical memory medium for at least one of a control and regulating system of an internal combustion engine, the electrical memory medium storing a computer program that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein:

the final controlling devices each include one clamping device, each of which is able to hold the final controlling element of a respective final controlling device in a neutral position, and an activating device which is able to move the final controlling element out of the neutral position, to perform a function test, the activating devices of the final controlling devices are activated in such a way that the final controlling elements move into a test position when the final controlling elements are in the test position, activation is ended and a period of time required for the final controlling elements to move from the test position into the neutral position is detected.

9. A control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein:

the final controlling devices each include one clamping device, each of which is able to hold the final controlling element of a respective final controlling device in a neutral position, and an activating device which is able to move the final controlling element out of the neutral position, to perform a function test, the activating devices of the final controlling devices are activated in such a way that the final controlling elements move into a test position when the final controlling elements are in the test position, activation is ended and a period of time required for the final controlling elements to move from the test position into the neutral position is detected.

10. An internal combustion engine, comprising:

a control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein:

the final controlling devices each include one clamping device, each of which is able to hold the final controlling element of a respective final controlling device in a neutral position, and an activating device which is able to move the final controlling element out of the neutral position, to perform a function test, the activating devices of the final controlling devices are activated in such a way that the final controlling elements move into a test position when the final controlling elements are in the test position, activation is ended and a period of time required for the final controlling elements to move from the test position into the neutral position is detected.

11. A computer-readable medium having stored thereon instructions that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein, in certain operating situations of the internal combustion engine, instantaneous properties of a final controlling device are detected independently of another final controlling device and are made available for the activation.

12. An electrical memory medium for at least one of a control and regulating system of an internal combustion engine, the electrical memory medium storing a computer program that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein, in certain operating situations of the internal combustion engine, instantaneous properties of a final controlling device are detected independently of another final controlling device and are made available for the activation.

13. A control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein, in certain operating situations of the internal combustion engine, instantaneous properties of a final controlling device are detected independently of another final controlling device and are made available for the activation.

14. An internal combustion engine, comprising:

a control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein, in certain operating situations of the internal combustion engine, instantaneous properties of a final controlling device are detected independently of another final controlling device and are made available for the activation.

15. A computer-readable medium having stored thereon instructions that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein status information about a final controlling device and its components is stored independently of another final controlling device.

16. An electrical memory medium for at least one of a control and regulating system of an internal combustion engine, the electrical memory medium storing a computer program that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein status information about a final controlling device and its components is stored independently of another final controlling device.

17. A control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein status information about a final controlling device and its components is stored independently of another final controlling device.

18. An internal combustion engine, comprising:

a control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein status information about a final controlling device and its components is stored independently of another final controlling device.

19. A computer-readable medium having stored thereon instructions that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein error information is evaluated jointly for all final controlling devices and corresponding responses are triggered.

20. An electrical memory medium for at least one of a control and regulating system of an internal combustion engine, the electrical memory medium storing a computer program that when executed results in a performance of the following:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein error information is evaluated jointly for all final controlling devices and corresponding responses are triggered.

21. A control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein error information is evaluated jointly for all final controlling devices and corresponding responses are triggered.

22. An internal combustion engine, comprising:

a control and/or regulating system for an internal combustion engine programmed to execute the following steps:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein error information is evaluated jointly for all final controlling devices and corresponding responses are triggered.

23. A method for operating an internal combustion engine, comprising:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable; wherein:

the final controlling devices each include one clamping device, each of which is able to hold the final controlling element of a respective final controlling device in a neutral position, and an activating device which is able to move the final controlling element out of the neutral position, to perform a function test, the activating devices of the final controlling devices are activated in such a way that the final controlling elements move into a test position when the final controlling elements are in the test position, activation is ended and a period of time required for the final controlling elements to move from the test position into the neutral position is detected.

24. The method as recited in claim 23, wherein the function test is carried out in separate test blocks for each final controlling device, the test blocks being coordinated with each other.

25. A method for operating an internal combustion engine, comprising:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein error information is evaluated jointly for all final controlling devices and corresponding responses are triggered.

26. The method as recited in claim 25, wherein identical error information of the final controlling devices is gated using a logical "or."

27. A method for operating an internal combustion engine, comprising:

supplying a combustion air to at least one combustion chamber via at least one intake duct that includes at least two parallel control sections to each of which one final controlling device is allocated, and by which the flow cross-section of the particular control section is able to be influenced; and activating at least two final controlling devices based on one single setpoint variable;

wherein each final controlling device has its own closed-loop position control to which the same setpoint variable is supplied.

28. The method as recited in claim 27, wherein a final controlling device includes at least two position sensors which detect the instantaneous position of a final controlling element belonging to the final controlling device, and a plausibility of signals from the position sensors is monitored.

29. The method as recited in claim 28, further comprising:

if an error occurs, determining which of the position sensors is defective by forming one value each for a partial air-mass flow from the signals of the position sensors of all final controlling devices; and checking for plausibility the determined values for the partial air-mass flow with reference to a value for a measured total air-mass flow.

* * * * *